US006220168B1

(12) United States Patent
Woodall et al.

(10) Patent No.: US 6,220,168 B1
(45) Date of Patent: Apr. 24, 2001

(54) UNDERWATER INTELLIGENCE GATHERING WEAPON SYSTEM

(75) Inventors: Robert Woodall, Lynn Haven; Felipe Garcia, Panama City; John Sojdehei, Panama City Beach, all of FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/304,537

(22) Filed: May 4, 1999

(51) Int. Cl.[7] ..... F42B 22/00; F42B 22/44; F42B 22/20; F42B 22/04

(52) U.S. Cl. ..... 102/411; 102/411; 102/413; 102/414; 102/417; 367/3; 367/134

(58) Field of Search ..... 102/413, 411, 102/417, 414, 214, 212; 367/3, 134

(56) References Cited

U.S. PATENT DOCUMENTS 3,811,379 * 5/1974 Sondheimer ..... 102/13
4,059,052 * 11/1977 Karr ..... 102/214
4,203,160 * 5/1980 Doherty ..... 367/2
4,372,239 * 2/1983 Hagelberg et al. ..... 114/20
4,487,102 * 12/1984 Fritz ..... 89/1.55
4,975,912 * 12/1990 Hogge ..... 367/96
5,119,341 * 6/1992 Youngberg ..... 367/5
5,452,262 * 9/1995 Hagerty ..... 367/6
5,579,285 * 11/1996 Hubert ..... 367/133
5,741,167 * 4/1998 Hagerty ..... 441/13
5,969,608 * 10/1999 Sojdehei et al. ..... 340/551

* cited by examiner

*Primary Examiner*—Michael J. Carone
*Assistant Examiner*—Lulit Semunegus
(74) *Attorney, Agent, or Firm*—Harvey A. Gilbert; Donald G. Peck

(57) ABSTRACT

An underwater intelligence gathering weapon system accurately places a weapon underwater and then communicates therewith from other platform(s). The weapon is equipped to maneuver through the air to a destination at the water's surface. A first transceiver, mounted onboard the weapon and coupled to the mine's logic portion, is activated after the weapon is in the water. The first transceiver can send and receive magneto-inductive signals. A second transceiver that sends and receives magneto-inductive signals is remotely located with respect to the first transceiver. Once deployed, the weapon can be controlled from a safe distance and can report any intelligence information collected by onboard sensors.

20 Claims, 2 Drawing Sheets

UNDERWATER INTELLIGENCE GATHERING WEAPON SYSTEM

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to underwater weapons, and more particularly to a weapon system that improves underwater placement accuracy while also providing for intelligence gathering and transmission from the weapon, and remote command and control of the weapon once it has been placed.

BACKGROUND OF THE INVENTION

Mines placed out at sea typically are configured to detect a particular stimulus supplied by an ocean going vessel in order to detonate a large explosive warhead for the purpose of sinking or incapacitating the vessel. Mine fields placed in the littoral regions of the world are used for offensive and defensive purposes. Offensively, placement of mines in a littoral region can destroy an enemy entering a mine field and/or limit the enemy maneuverability. Defensively, a littoral-region mine field can keep an enemy from attacking through a certain region.

Currently, underwater mines are placed by aircraft. Placement precision is generally not very good and results in placement errors of hundreds of yards. The higher the altitude of the aircraft when the mine is released, the greater the placement error will be. Thus, in terms of mine placement in littoral regions, aircraft sometimes have to come precariously close to an enemy shore which can result in nullifying a covert mission and/or allow the enemy to target and fire upon the aircraft.

In addition to placement problems, mines do not possess the ability to be remotely controlled in an efficient fashion from a safe location. Rather, underwater mines are preprogrammed to respond to seismic, pressure, acoustic and/or magnetic influences to yield detonation. Some efforts are underway to try to remotely command and control mines by use of acoustic signals. However, acoustic signals propagated through water for mine control can be quite unreliable especially in shallow and very shallow water regimes where high surface and bottom reverberation losses exist. Acoustic control can also be negated by the presence of air bubbles, ambient and man-made acoustic noise in the water near the receiver. Acoustic communications through water is further greatly affected by the multipaths, thermoclines and echoes from other sonar sources in the area.

Finally, although underwater mines are covert once located, this capability is not currently exploited. That is, mines are not operated as an intelligence gathering post that detects, for example, the number of vessels traversing an area, environmental conditions, etc., and reports back to a remote station.

SUMMARY OF THE INVENTION

Accordingly, it is an object of the present invention to provide an underwater mine system that allows precise placement of and communication with an underwater mine.

Another object of the present invention is to provide an underwater mine system that can be released from an aircraft at a safe standoff range.

Still another object of the present invention is to provide for remote command and control of an underwater mine.

Other objects and advantages of the present invention will become more obvious hereinafter in the specification and drawings.

In accordance with the present invention, an underwater intelligence gathering weapon system uses a mine having a logic portion for controlling explosive operation thereof. Navigation means are physically coupled to the mine for maneuvering it through the air to a destination at the surface of a body of water after being deployed in air from an aircraft. A first transceiver is mounted onboard the mine and is coupled to the mine's logic portion. The first transceiver is activated after the mine arrives at its destination in the water. The first transceiver will at least receive signals that can control the mine's logic portion. The signals are magneto-inductive in nature for transmission through the body of water. More specifically, the signals are digital tones modulated on a carrier frequency not to exceed approximately 4000 hertz. A second transceiver that transmits the signals into the body of water is remotely located with respect to the first transceiver.

DETAILED DESCRIPTION OF THE INVENTION

Figure 1:
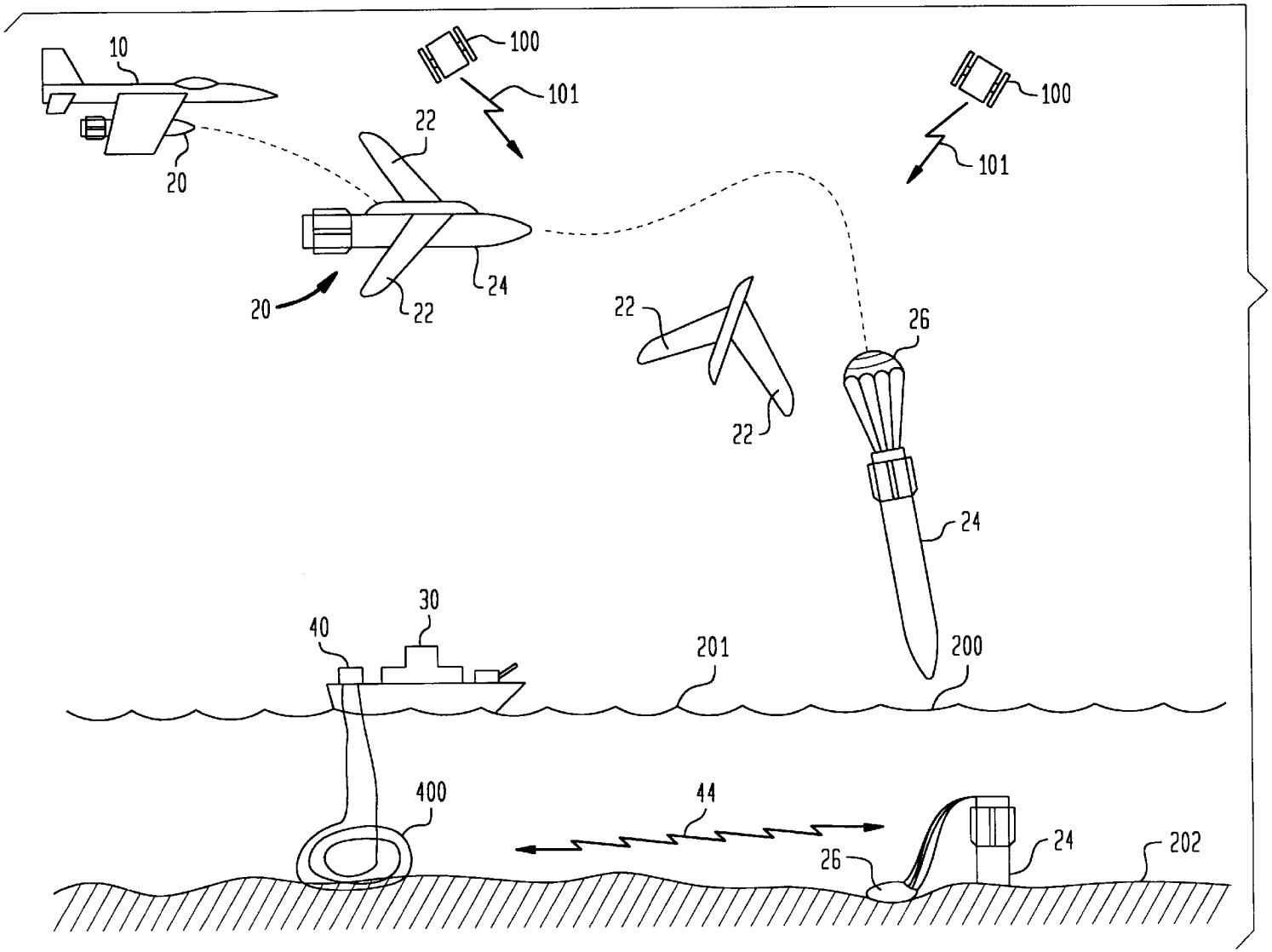
FIG. 1 depicts an operation scenario using the system of the present invention to accurately place and command/control an underwater mine.

Referring now to the drawings, and more particularly to FIG. 1, a deployment sequence and operation scenario for the present invention is shown for use in a deep sea or littoral weapon placement mission. A host vehicle 10 travels to the vicinity (e.g., a typical standoff range of 50–75 nautical miles) of an in-air deployment destination at which point a weapon such as a mine 20 equipped for air travel is released therefrom. In general, host vehicle 10 is an aircraft (e.g., plane, helicopter, etc.) that can travel quickly to and from the vicinity of deployment without being easily detected by enemy surveillance. Once within the desired vicinity at a desired altitude and air speed, host vehicle 10 releases mine 20 which is capable of maneuvering using GPS signals 101 originating from GPS satellites 100 orbiting the earth. Mine 20 can also be equipped with an onboard inertial navigation system to supplement or back-up the GPS navigation capabilities in the event of GPS signal jamming problems.

Mine 20 is maneuvered to a ballistic drop zone approximately above a sea-surface deployment destination (referenced by numeral 200) located on the surface 201 of a body of water. To accomplish such navigational maneuvering of mine 20, wings 22 can be attached to a mine body or casing 24 that typically houses explosives and control logic governing the mine's operation. In accordance with the present invention, communications equipment (not shown in FIG. 1) is also maintained onboard casing 24 to provide for the remote control of the mine's control logic and, if desired, provide for two-way communication with a remote site as will be explained further below.

At a desired altitude and range from deployment destination 200, wings 22 can be separated from casing 24. Once wings 22 are jettisoned, a drag device such as a parachute 26 slows the ballistic descent of casing 24. Upon impact with surface 201 of the body of water, parachute 26 can stay with (as illustrated) or be caused to separate from casing 24. At this point, casing 24 typically sinks to the bottom 202 under the weight of casing 24 and its contents.

Command and control of the contents of mine casing 24 originates from one or more remotely located land, air or sea platform(s). By way of example, a seagoing command and control vessel 30 supplies command and control information to an onboard transceiver 40. Transceiver 40 includes an antenna 400 capable of transmitting and receiving magneto-inductive communications 44 (e.g., command and control information) through the water. Accordingly, communications 44 is shown as bidirectional. As is known in the art, magneto-inductive communications 44 are low-frequency electromagnetic signals capable of seawater propagation over short distances of approximately 50 nautical miles or less. In terms of the present invention, communications 44 are digital signals that have been converted to audio tone bursts modulated on a carrier frequency as will be described further below.

Figure 2:
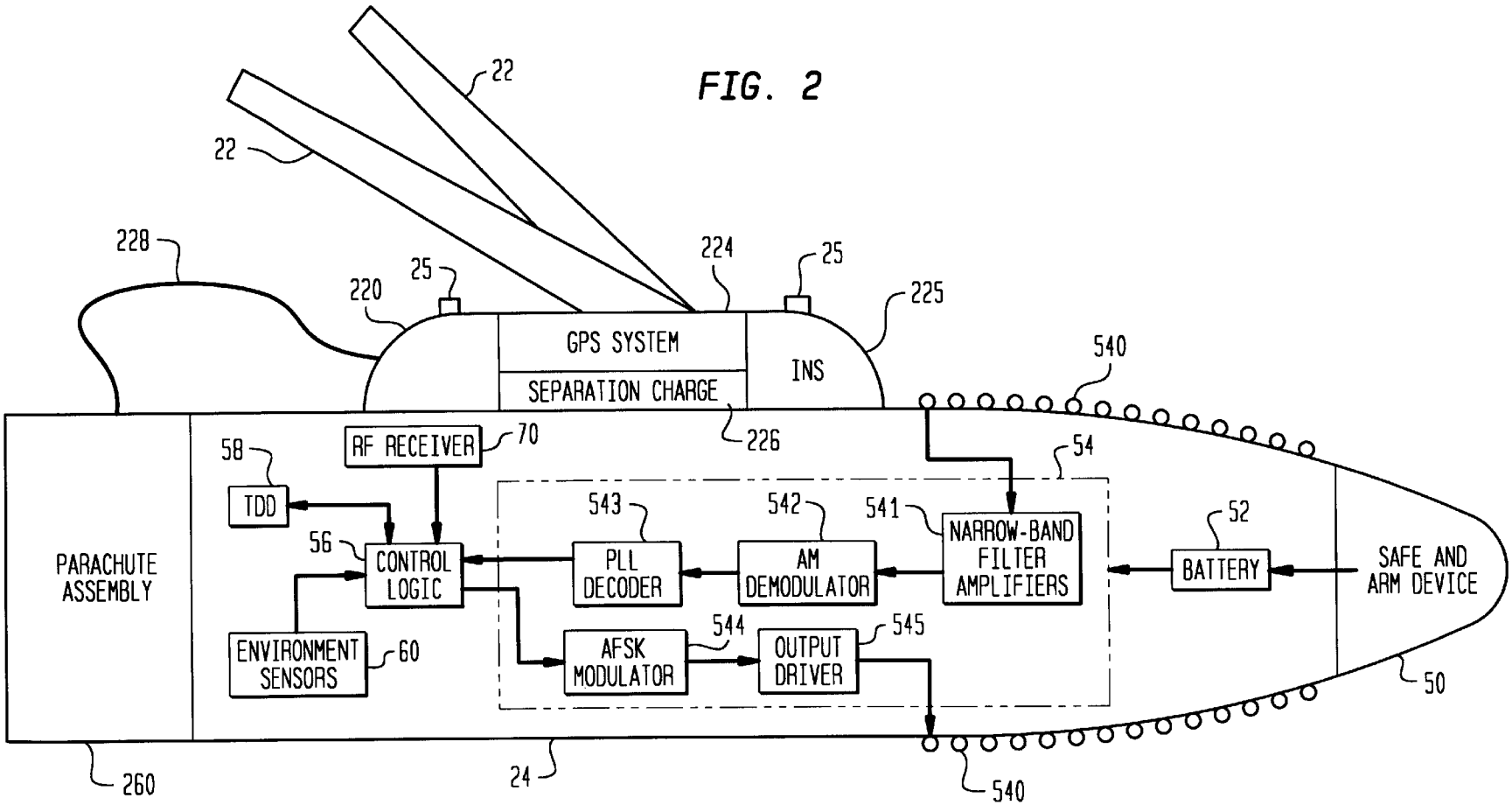
FIG. 2 is a schematic view of one embodiment of a mine used in the present invention.

One embodiment of mine 20 is shown schematically in FIG. 2 where casing 24 represents the casing of an underwater mine such as one of the MK60 series used by the U.S. Navy. However, other specially designed mine casings or delivery vehicles can also be used. A wing "kit" is attached to casing 24. The wing "kit" can deploy wings 22 to allow casing 24 to glide and steer as a winged aircraft and then jettison the wings at a given time or location to allow body 24 to fall ballistically. A variety of such wing "kits" are known in the art and are available commercially. One such commercially available system is the Longshot™ GPS Guided Wing Kit manufactured by Leigh Aero Systems, Carlsbad, Calif. Briefly, this wing kit includes a base 220 mounted to casing 24 using, for example, aircraft lug mounts 25 provided on casing 24. Wings 22 extend from casing 24 once it is free from the host aircraft. The wing kit has its own GPS system 224 for determining range and altitude. An inertial navigation system (INS) 225 can also be included as a back-up to GPS system 224. At a given range to a target location and/or altitude, a separation charge 226 is initiated to cause the combination of base 220 and wings 22 to be jettisoned from casing 24.

Base 220 can be coupled mechanically or electromechanically to a parachute assembly 260 at the aft end of casing 24. Stored within parachute assembly 260 is a parachute (not shown in FIG. 2) that deploys (see parachute 26 in FIG. 1) as base 220 separates from casing 24. For example, a lanyard 228 can be coupled to base 220 and parachute assembly 260 so that as base 220 and wings 22 are jettisoned, lanyard 228 pulls the parachute from parachute assembly 260. Lanyard 228 would then release due to the aerodynamic and tensile forces acting on the jettisoned base 220 and wings 22.

A safe-and-arm device 50 is provided in the nose of casing 24. Safe-and-arm device 50 is coupled to transceiver components onboard casing 24 for at least receiving magneto-inductive communications 44 from transceiver 40. By way of example, one transceiver arrangement is depicted in FIG. 2. Safe and arm device 50 is coupled to a battery or other power source 52 that is activated to supply power to transceiver components 54 and, if necessary, to the mine's control logic 56 and the mine's target detection device (TDD) 58. In general, battery 52 is allowed to supply its power when safe and arm device 50 impacts the water's surface. Such safe and arm devices are well known in the field of airborne munitions.

Control logic 56 represents a central processing unit and non-volatile memory storing programming used to control mine operation. Target detection device 58, when activated, initiates the mine's explosive operation in response to some stimulus, e.g., noise, pressure change, magnetic field, etc. Control logic 56 and target detection device 58 are systems/devices well understood in the art of mine construction and therefore will not be described further herein.

With battery 52 supplying power, transceiver 54 can begin to receive communications 44 originating from remotely located transceiver 40. Accordingly, transceiver 54 includes an antenna wire 540 wrapped about casing 24. Antenna 540 is wrapped in this way to effectively increase the useful range of transceiver 54 in terms of magneto-inductive communications. To minimize internal circuit noise while maintaining a high gain, antenna 540 is coupled to a series of high-gain narrow-band filter amplifiers 541. Amplifiers 541 would typically be arranged in a superheterodyne configuration as is known in the art. The output of amplifiers 541 is supplied to an amplitude modulation (AM) demodulator 542 to detect the smallest amplitude modulation of the carrier frequency used to send magneto-inductive communications 44. The output of demodulator 542 is supplied to a narrow-band phase locked loop (PLL) based tone decoder 543. Decoder 543 converts the digital tone bursts of communications 44 into corresponding voltage levels in order to reconstruct the digital data originally used to create communications 44. The output of decoder 543 is then supplied to control logic 56.

The command and control information contained in communications 44 being supplied to transceiver 54 can simply be a signal causing control logic 56 to begin or cease normal mine operations. That is, control logic 56 could be commanded to activate or deactivate target detection device 58. However, communications 44 could also be used to completely reprogram control logic 56 in the case of a changing mission scenario.

Transceiver 54 can also be used to transmit magneto-inductive communications that might be useful back onboard command and control vessel 30. Transmission could range from simple acknowledgment of commands received to the supplying of status and/or intelligence gathering surveillance data as will be explained below. Regardless of the type of transmission, digital tones indicative of the data to be sent are input to an audio frequency shift keying modulator (AFSK) 544. Modulator 544 is supplied with a carrier frequency in the ELF or VLF range. Preferably, the carrier frequency does not exceed approximately 4000 hertz in order to limit areas of transmission interference from other underwater sources and to provide an adequate data exchange rate. The modulated tones are supplied to an output driver stage 545 which, in turn, is coupled to antenna 540. Note that a similar arrangement of components can be used for transceiver 40 located onboard command and control vessel 30.

As mentioned above, transceiver 54 can be used to transmit a variety of types of transmissions. Simple acknowledgment of commands received could be passed directly from control logic 56 to modulator 544 for retransmission. Status of the mine (e.g., on/off, armed/disarmed, ready to deactivate, etc.) can be provided from target detection device 58 and/or control logic 56 to modulator 544. Still further, the present invention can be used for underwater surveillance. To do so, environment sensors 60 (e.g., acoustic, pressure, magnetic, etc.) provide sensed data to control logic unit 56/transceiver 54 for transmission to command and control vessel 30. Assuming sensors 60 are digital sensors capable of outputting the appropriate digital tones, their outputs could be applied directly to modulator 544 for transmission preparation. Sensors 60 can provide information regarding the number and types of watercraft traveling in the area of the mine and/or simply information on tidal or wave action.

An RF receiver 70 can optionally be maintained onboard casing 24. RF receiver 70 is coupled to control logic 56. When mine 20 is in flight as illustrated in FIG. 1, host vehicle 10 (or some other platform) can issue commands to update or change the programming of control logic 56. Then, once casing 24 has impacted water surface 201, magneto-inductive communications 44 can be used to update or change control logic 56 as described above. In this way, control logic 56 (and thus mine operation) can be remotely controlled during all phases of mine deployment.

The advantages of the present invention are numerous. Underwater mines can be remotely delivered from a safe standoff distance and precisely placed at their desired destination. Such precision placement means that a mine field can be accurately mapped by friendly forces. Once placed, the present invention provides for the remote command and control and/or communication with the mine from a safe standoff range. Command and control can include mine arming/disarming, detonation, sterilization, etc. Communication from the mine can also include surveillance data on the area of placement. The surveillance data can be used, for example, to indicate the number of transient ships through the area and store this information for later on-command retrieval. The mine could be commanded to be turned off to allow for the passage of friendly ships and/or forces.

Although the invention has been described relative to a specific embodiment thereof, there are numerous variations and modifications that will be readily apparent to those skilled in the art in light of the above teachings. For example, the present invention could be used for pure intelligence gathering, i.e., no weapon is onboard the vehicle housing transceiver 54. Further, transceiver 40 could be maintained on a buoy as a relay station that includes an RF receiver for receiving RF control signals from an even more remote command platform. The carrier frequency used for tone modulation can be changed based on the depth of the mine. Thus, it is therefore to be understood that, within the scope of the appended claims, the invention may be practiced other than as specifically described.

What is claimed as new and desired to be secured by Letters Patent of the United States is:

1. An underwater weapon system comprising:

a mine equipped to travel in air to a destination at the surface of a body of water;

a first transceiver for transmitting and receiving magneto-inductive signals, said first transceiver mounted onboard and coupled to said mine, said first transceiver being activated after said mine arrives at said destination; and a second transceiver for transmitting and receiving magneto-inductive signals, said second transceiver being remotely located with respect to said first transceiver, said second transceiver communicating with said first transceiver using the body of water as a transmission media for said magneto-inductive signals.

2. An underwater weapon system as in claim 1 wherein said mine comprises:

a mine casing;

a wing kit coupled to said mine casing for guiding said mine casing through the air and for separating from said mine casing at an in-air location approximately above said destination;

a drag device coupled to said mine casing for reducing the speed of said mine casing as it descends ballistically from said in-air location under the force of gravity towards said destination when said wing kit is separated from said mine casing; and a safe and arm device coupled to said mine casing for activating said first transceiver when said mine casing strikes the surface of the body of water.

3. An underwater weapon system as in claim 2 wherein said first transceiver includes an antenna wrapped about said mine casing.

4. An underwater weapon system as in claim 2 wherein said wing kit includes GPS navigation capability.

5. An underwater weapon system as in claim 4 wherein said wing kit includes inertial navigation capability.

6. An underwater weapon system as in claim 2 wherein said drag device is a parachute.

7. An underwater weapon system as in claim 1 wherein said mine includes an explosive portion, and further comprising a target detection device programmed to activate said explosive portion in response to a specified stimulus, said target detection device coupled between said first transceiver and said explosive portion wherein activation of said target detection device can be controlled by said magneto-inductive signals received from said second transceiver.

8. An underwater weapon system as in claim 1 wherein said magneto-inductive signals are digital tones modulated at a carrier frequency not to exceed approximately 4000 hertz.

9. An underwater weapon system as in claim 1 further comprising at least one sensor mounted on said mine for detecting a condition, said at least one sensor being coupled to said first transceiver for transmitting said condition in the form of said magneto-inductive signals.

10. An underwater weapon system comprising:

a mine having a logic portion for controlling explosive operation of said mine;

navigation means physically coupled to said mine for maneuvering said mine through the air to a destination at the surface of a body of water after said mine is deployed in air from an aircraft;

a first transceiver mounted onboard said mine and coupled to said logic portion, said first transceiver being activated after said mine arrives at said destination to at least receive signals that will control said logic portion, said signals being transmitted through the body of water as digital tones modulated on a carrier frequency not to exceed approximately 4000 hertz; and a second transceiver for at least transmitting said signals into the body of water, said second transceiver being remotely located with respect to said first transceiver.

11. An underwater weapon system as in claim 10 further comprising an RF receiver mounted onboard said mine and coupled to said logic portion for receiving radio frequency signals that can control said logic portion while said mine is maneuvering through the air.

12. An underwater weapon system as in claim 10 wherein said first transceiver includes an antenna wire wrapped about said mine.

13. An underwater weapon system as in claim 10 wherein said navigation means comprises:

a wing kit coupled to said mine for guiding said mine through the air and for separating from said mine at an in-air location approximately above said destination;

a drag device coupled to said mine for reducing the speed of said mine as it descends ballistically from said in-air location under the force of gravity towards said destination when said wing kit is separated from said mine; and a safe and arm device coupled to said mine for activating said first transceiver when said mine strikes the surface of the body of water.

14. An underwater weapon system as in claim 13 wherein said wing kit includes GPS navigation capability.

15. An underwater weapon system as in claim 14 wherein said wing kit includes inertial navigation capability.

16. An underwater weapon system as in claim 13 wherein said drag device is a parachute.

17. An underwater weapon system as in claim 10 further comprising at least one sensor mounted on said mine for detecting a condition, said at least one sensor being coupled to said first transceiver for transmitting said condition in the form of said signals.

18. An underwater intelligence gathering system comprising:

a vehicle equipped to travel in air to a destination at the surface of a body of water;

a first transceiver for transmitting and receiving magneto-inductive signals, said first transceiver mounted onboard and coupled to said vehicle, said first transceiver being activated after said vehicle arrives at said destination;

second transceiver for transmitting and receiving magneto-inductive signals, said second transceiver being remotely located with respect to said first transceiver, said second transceiver communicating with said first transceiver using the body of water as a transmission media for said magneto-inductive signals; and at least one sensor mounted on said vehicle for detecting a condition, said at least one sensor being coupled to said first transceiver for transmitting said condition in the form of said magneto-inductive signals.

19. An underwater intelligence gathering system as in claim 18 wherein said first transceiver includes an antenna wrapped about said vehicle.

20. An underwater intelligence gathering system as in claim 18 wherein said magneto-inductive signals are digital tones modulated at a carrier frequency not to exceed approximately 4000 hertz.

* * * * *